US011490498B2

(12) United States Patent
Matsuhana et al.

(10) Patent No.: US 11,490,498 B2
(45) Date of Patent: Nov. 1, 2022

(54) X-RAY INSPECTION APPARATUS AND DETERIORATION DETERMINATION METHOD FOR X-RAY INSPECTION APPARATUS

(71) Applicant: Shimadzu Corporation, Kyoto (JP)

(72) Inventors: Bunta Matsuhana, Kyoto (JP); Goro Kambe, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/365,189

(22) Filed: Jul. 1, 2021

(65) Prior Publication Data

US 2022/0151050 A1 May 12, 2022

(30) Foreign Application Priority Data

Nov. 9, 2020 (JP) ..... JP2020-186406

(51) Int. Cl.

| | |
|---|---|
| ***H05G 1/54*** | (2006.01) |
| ***H05G 1/32*** | (2006.01) |
| ***H01J 35/02*** | (2006.01) |
| ***H05G 1/10*** | (2006.01) |

(52) U.S. Cl.

CPC ..... *H05G 1/54* (2013.01); *H01J 35/025* (2013.01); *H05G 1/10* (2013.01); *H05G 1/32* (2013.01)

(58) Field of Classification Search

CPC .... H05G 1/54; H05G 1/10; H05G 1/32; H01J 35/025

See application file for complete search history.

(56) References Cited

U.S. PATENT DOCUMENTS

| | | | | |
|---|---|---|---|---|
| 5,398,274 A * | 3/1995 | Komatani | H05G 1/54 | 378/98 |
| 6,426,997 B1 * | 7/2002 | Fuchs | H05G 1/34 | 378/118 |
| 2006/0008053 A1 | 1/2006 | Ishikawa et al. | | |
| 2008/0123815 A1 * | 5/2008 | Feda | G01N 23/223 | 378/112 |

FOREIGN PATENT DOCUMENTS

| | | |
|---|---|---|
| JP | 2011147806 A * | 8/2011 |
| WO | 03/092336 A1 | 11/2003 |

* cited by examiner

*Primary Examiner* — Chih-Cheng Kao

(74) *Attorney, Agent, or Firm* — Maier & Maier, PLLC

(57) ABSTRACT

Provided is an X-ray inspection apparatus including: an X-ray tube configured to generate X-rays; a high-voltage power source configured to supply a tube voltage to the X-ray tube to generate X-rays; an X-ray irradiation control section configured to output a first control signal and a second control signal to the high-voltage power source to control the high-voltage power source; and a determination section configured to count at least one of the first control signal and the second control signal output from the X-ray irradiation control section to the high-voltage power source, compare a counted count value with a preset threshold value, and determine a deterioration state of a component constituting the X-ray tube.

6 Claims, 3 Drawing Sheets

X-RAY INSPECTION APPARATUS AND DETERIORATION DETERMINATION METHOD FOR X-RAY INSPECTION APPARATUS

INCORPORATION BY REFERENCE

The present application claims priority under 35 U.S.C. § 119 to Japanese Patent Application No. 2020-186406 filed on Nov. 9, 2020. The content of the application is incorporated herein by reference in its entirety.

BACKGROUND

Technical Field

The present invention relates to an X-ray inspection apparatus and a deterioration determination method for the X-ray inspection apparatus.

Related Art

An X-ray inspection apparatus includes an X-ray tube, and generates X-rays by heating a filament included in the X-ray tube and applying, to a target, thermal electrons generated from the heated filament. The X-ray tube includes a plurality of consumables, and a technique for predicting a replacement time of these consumables is known.

For example, WO 2003/092336 A discloses an X-ray tube operating state acquiring device that determines a degree of life consumption of a filament based on an energization time of the filament.

SUMMARY

The X-ray tube includes the plurality of consumables in addition to the filament. If the replacement time of the consumables including the filament can be accurately determined, it is possible to avoid the occurrence of downtime or shorten the downtime.

An object of the present invention is to provide an X-ray inspection apparatus and a deterioration determination method for the X-ray inspection apparatus in which determination accuracy in deterioration determination of a component constituting an X-ray tube is improved.

According to a first aspect of the present invention, there is provided an X-ray inspection apparatus including: an X-ray tube configured to generate X-rays; a high-voltage power source configured to supply a tube voltage to the X-ray tube to generate X-rays; an X-ray irradiation control section configured to output a first control signal for causing the high-voltage power source to start supply of the tube voltage and a second control signal for causing the high-voltage power source to stop the supply of the tube voltage to control the high-voltage power source; and a determination section configured to count at least one of the first control signal and the second control signal output from the X-ray irradiation control section to the high-voltage power source, compare a counted count value with a preset threshold value, and determine a deterioration state of a component constituting the X-ray tube.

According to a second aspect of the present invention, there is provided a deterioration determination method for an X-ray inspection apparatus including an X-ray tube configured to generate X-rays, and a high-voltage power source configured to supply a tube voltage to the X-ray tube to generate X-rays, the deterioration determination method including: a step of counting at least one of a first control signal for causing the high-voltage power source to start supply of the tube voltage and a second control signal for causing the high-voltage power source to stop the supply of the tube voltage; and a step of determining a deterioration state of a component constituting the X-ray tube by comparing a counted count value with a preset threshold value.

According to the X-ray inspection apparatus of the first aspect of the present invention and the deterioration determination method for the X-ray inspection apparatus of the second aspect of the present invention, the deterioration state of the component constituting the X-ray tube can be determined based on the number of times of supply of the tube voltage from the high-voltage power source to the X-ray tube. Therefore, it is possible to accurately determine the deterioration state of the component that is deteriorated when the tube voltage is supplied to the X-ray tube.

DETAILED DESCRIPTION

Hereinafter, the present embodiment will be described with reference to the accompanying drawings.

1. Configuration

Figure 1:
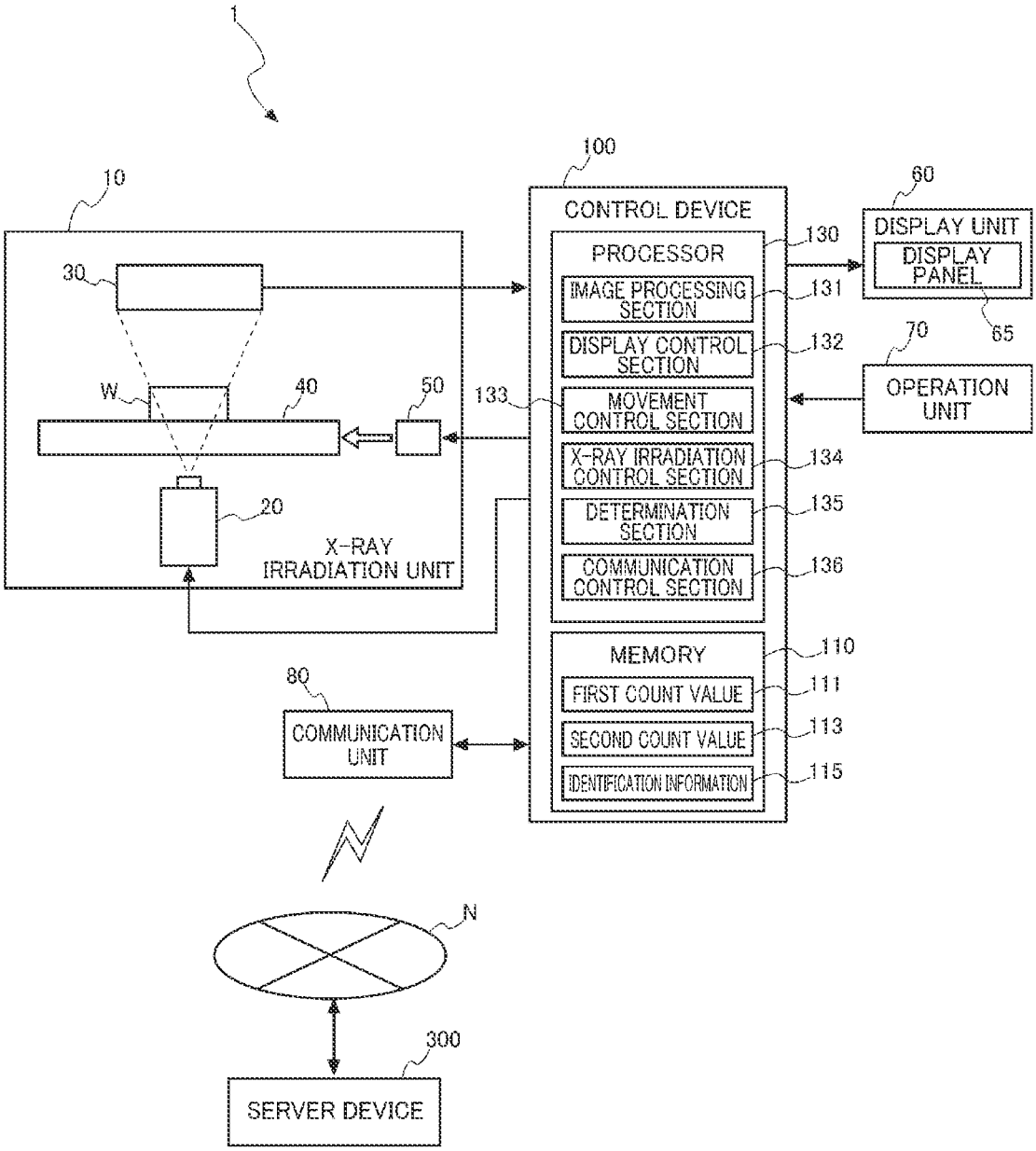
FIG. 1 is a configuration diagram of an X-ray inspection apparatus.

FIG. 1 is a configuration diagram of an X-ray inspection apparatus 1.

The X-ray inspection apparatus 1 includes an X-ray irradiation unit 10, a display unit 60 (display), an operation unit 70, a communication unit 80 (transmitter/receiver, circuit), and a control device 100. The X-ray irradiation unit 10 includes an X-ray generation unit 20, an X-ray detection unit 30, a stage 40, and a moving mechanism 50. The X-ray irradiation unit 10 is disposed inside a casing including an X-ray shielding member.

The X-ray generation unit 20 includes an X-ray tube 210 (see FIG. 2), and irradiates a workpiece W, which is an inspection object placed on the stage 40, with X-rays.

The X-ray detection unit 30 detects the X-rays transmitted through the workpiece W on the stage 40. The X-ray detection unit 30 includes, for example, a line sensor in which a large number of X-ray detection elements are linearly arranged, and detects the X-rays transmitted through the workpiece W.

The stage 40 is a member for placing the workpiece W, and is disposed between the X-ray generation unit 20 and the X-ray detection unit 30. The stage 40 is driven by a moving mechanism 50 including a motor, which is not illustrated, and is configured to be movable in two directions orthogonal to each other in a horizontal plane or in a vertical direction.

Figure 2:
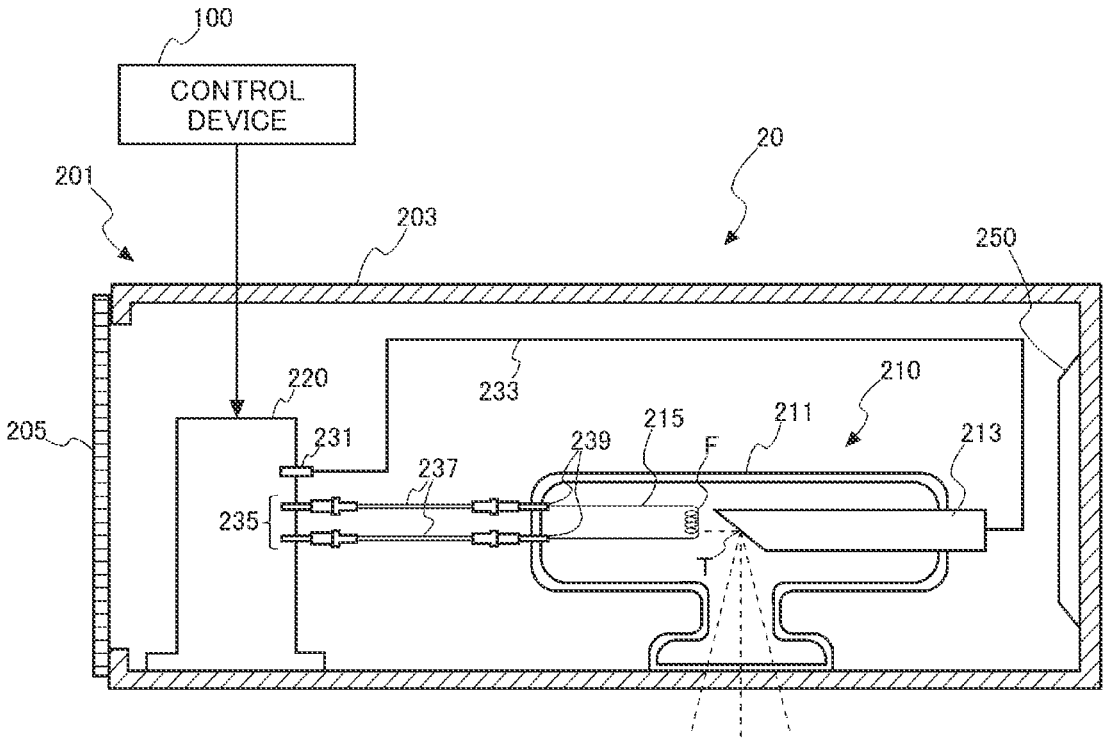
FIG. 2 is a diagram illustrating a schematic configuration of an X-ray generation unit.

FIG. 2 is a diagram illustrating a schematic configuration of the X-ray generation unit 20.

The configuration of the X-ray generation unit 20 will be described with reference to FIG. 2.

The X-ray generation unit 20 has a configuration in which the X-ray tube 210 and a high-voltage power source 220 are housed in a chamber 201 including a housing 203 and a lid body 205. The chamber 201 is filled with insulating oil. In the chamber 201, a rubber member 250 that is made of rubber and that prevents leakage of the insulating oil to the outside of the chamber 201 is provided. The rubber member 250 is a rubber bellows and is in contact with the insulating oil. The rubber member 250 absorbs a volume change of the insulating oil due to thermal expansion and adjusts a pressure of the insulating oil in the chamber 201.

The X-ray tube 210 includes a glass tube body 211. In the glass tube body 211, an anode portion 213 including a target T and a cathode portion 215 including a filament F are disposed. For example, metal such as tungsten or molybdenum is used for the target T, and for example, tungsten is used for the filament F.

The anode portion 213 is connected to the high-voltage power source 220 via a terminal 231 and a wiring 233.

The cathode portion 215 is connected to the high-voltage power source 220 via terminals 235, wiring bodies 237, and terminals 239.

The high-voltage power source 220 supplies a predetermined voltage to each of the anode portion 213 and the cathode portion 215 to generate a potential difference (hereinafter, referred to as a tube voltage) between the anode portion 213 and the cathode portion 215. The high-voltage power source 220 supplies a filament current to the cathode portion 215. When the filament current is supplied to the cathode portion 215 in a state where a predetermined potential difference is generated between the anode portion 213 and the cathode portion 215, the cathode portion 215 is heated, and thermal electrons are emitted from the cathode portion 215. The thermal electrons emitted from the cathode portion 215 collide with the anode portion 213 to generate X-rays. The generated X-rays are emitted to the outside of the X-ray tube 210 through an X-ray irradiation window, which is not illustrated.

The X-ray tube 210 has a sealed configuration in which the filament F, the target T, and the like are disposed in the glass tube body 211 which is a sealed container. However, the present invention can also be applied to an X-ray inspection apparatus 1 including an open type X-ray tube in which the filament F, the target T, and the like can be replaced as a single body.

Returning to FIG. 1, a configuration of the X-ray inspection apparatus 1 will be described.

The display unit 60 includes a display panel 65. The display unit 60 displays an image based on display data input from the control device 100 on the display panel 65. The image based on the display data includes an X-ray image detected by the X-ray detection unit 30.

The operation unit 70 includes a plurality of operation buttons. The operation unit 70 outputs, to the control device 100, an operation signal corresponding to the operation button with which the operation has been received to the control device 100.

The communication unit 80 is connected to a network N such as the Internet in a wired or wireless manner. The communication unit 80 performs data communication with a server device 300 (computer) connected to the network N.

The control device 100 is a computer device including a memory 110 and a processor 130.

The memory 110 includes, for example, a non-volatile memory such as a flash memory or an electrically erasable programmable read only memory (EEPROM). In addition, the memory 110 may be configured to include a volatile memory such as a random access memory (RAM) in addition to the nonvolatile memory. The memory 110 stores a control program executed by the processor 130 and the X-ray image detected by the X-ray detection unit 30. In addition, the memory 110 stores a first count value 111 and a second count value 113 which are the numbers of times of detection of a first control signal and a second control signal, respectively. Details of the first control signal and the second control signal will be described later. The memory 110 stores identification information 115 for uniquely identifying the X-ray inspection apparatus 1.

The processor 130 includes a microcomputer such as a central processing unit (CPU), a micro controller unit (MCU) on which the CPU is mounted, or a micro processor unit (MPU). Furthermore, the control device 100 may be realized by an integrated circuit such as an application specific integrated circuit (ASIC) or a field programmable gate array (FPGA).

The control device 100 includes an image processing section 131, a display control section 132, a movement control section 133, an X-ray irradiation control section 134, a determination section 135, and a communication control section 136. These functional blocks indicate functions of the control device 100 realized by the processor 130 executing the control program stored in the memory 110.

The image processing section 131 performs predetermined image processing on the X-ray image detected by the X-ray detection unit 30. The display control section 132 generates display data to be displayed on the display unit 60 based on the X-ray image subjected to the image processing by the image processing section 131, and outputs the generated display data to the display unit 60. As a result, the X-ray image is displayed on the display panel 65 of the display unit 60.

The movement control section 133 outputs a drive signal for driving the moving mechanism 50 to move the stage 40 in two directions orthogonal to each other in the horizontal plane.

The X-ray irradiation control section 134 controls the high-voltage power source 220 to irradiate the X-ray generation unit 20 with X-rays. The X-ray irradiation control section 134 outputs the first control signal and the second control signal to the high-voltage power source 220. The first control signal is a signal instructing the high-voltage power source 220 to output the tube voltage. The second control signal is a signal instructing the high-voltage power source 220 to stop the output of the tube voltage.

The X-ray irradiation control section 134 outputs the first control signal to the high-voltage power source 220 when, for example, the workpiece W is placed on the stage 40 and an instruction to start inspection is received by the operation unit 70. When the irradiation of the workpiece W with the X-rays is completed, the X-ray irradiation control section 134 outputs the second control signal to the high-voltage power source 220 to terminate the irradiation with the X-rays.

The determination section 135 counts at least one of the first control signal and the second control signal output from the X-ray irradiation control section 134 to the high-voltage power source 220. The determination section 135 compares the counted count value with a preset threshold value to determine the deterioration state of the component constituting the X-ray tube 210. The threshold value includes a first threshold value and a second threshold value. The determination section 135 of the present embodiment determines the deterioration state of the rubber member 250 and the filament F as the components of the X-ray tube 210.

The inside of the chamber 201 is filled with the insulating oil without a gap. When a tube voltage is applied to the X-ray tube 210 and a filament current is supplied to the cathode portion 215, the cathode portion 215 is heated and the insulating oil is expanded by the generated heat. When the application of the tube voltage to the X-ray tube 210 is stopped, the temperature of the cathode portion 215 decreases, and the expanded insulating oil contracts.

The rubber member 250 is a member that absorbs a volume change of the insulating oil due to thermal expansion and adjusts a pressure of the insulating oil in the chamber 201, and repeats expansion and contraction in accordance with expansion and contraction of the insulating oil. The rubber member 250 is deteriorated by repeating expansion and contraction. When the rubber member 250 is deteriorated and cannot absorb the volume of the insulating oil, oil leakage occurs, and the X-ray inspection apparatus 1 does not operate normally.

The filament F in the X-ray tube 210 receives a load when the filament current flows. The filament F is coated with aluminum oxide or the like and subjected to insulation processing. In the method of monitoring the cumulative energization time to the filament F as in the technique disclosed in WO 2003/092336 A, the influence of expansion and contraction on aluminum oxide cannot be accurately detected, and the degree of deterioration of aluminum oxide cannot be accurately determined.

Therefore, the determination section 135 counts the number of times of at least one of the first control signal and the second control signal output from the X-ray irradiation control section 134 to the high-voltage power source 220, detects the number of times the rubber member 250 expands or contracts, and detects the number of times the filament F receives the load.

When the second control signal is detected after the first control signal is detected, the determination section 135 of the present embodiment adds one to the first count value 111 and the second count value 113. The memory 110 stores the first count value 111 and the second count value 113 counted by the determination section 135.

The first count value 111 is used for determining the deterioration state of the rubber member 250.

When the first count value is equal to or larger than a preset first threshold value, the determination section 135 determines that the rubber member 250 is in a deterioration state, and causes the communication control section 136 to execute an operation of notification to the server device 300. Once the rubber member 250 is replaced and the operation unit 70 receives a predetermined operation, the determination section 135 resets the first count value 111.

The second count value 113 is used to determine the deterioration state of the filament F. When the second count value 113 is equal to or larger than a preset second threshold value, the determination section 135 determines that the filament F is in a deterioration state, and causes the communication control section 136 to execute the operation of notification. The second threshold value can be set to 10,000 times, for example. Once the filament F is replaced and the operation unit 70 receives a predetermined operation, the determination section 135 resets the second count value 113.

The determination section 135 of the present embodiment adds one to the first count value 111 and the second count value 113 when the second control signal is detected after the first control signal is detected, but may be configured to detect one of the first control signal and the second control signal and add one to the values of the first count value 111 and the second count value 113. Even with such a configuration, the number of times of expansion and contraction of the rubber member 250 and the number of times the filament F receives a load can be accurately detected.

When the determination section 135 determines that the first count value 111 is equal to or larger than the first threshold value, the communication control section 136 notifies the server device 300 of the determination result via the communication unit 80. The communication control section 136 transmits information indicating that the rubber member 250 is determined to be in the deterioration state and the identification information 115 of the X-ray inspection apparatus 1 to the server device 300 as the determination result.

When the determination section 135 determines that the second count value 113 is equal to or larger than the second threshold value, the communication control section 136 notifies the server device 300 of the determination result via the communication unit 80. The communication control section 136 transmits information indicating that the filament F is determined to be in the deterioration state and the identification information 115 of the X-ray inspection apparatus 1 to the server device 300 as the determination result.

In addition, the display control section 132 may cause the display unit 60 to display a predetermined display when the determination section 135 determines that the first count value 111 is equal to or larger than the first threshold value, or when the determination section 135 determines that the second count value 113 is equal to or larger than the second threshold value. For example, when the determination section 135 determines that the first count value 111 is equal to or larger than the first threshold value, the display control section 132 causes the display unit 60 to display a guidance for guiding the replacement of the rubber member 250. When the determination section 135 determines that the second count value 113 is equal to or larger than the second threshold value, the display control section 132 causes the display unit 60 to display a guidance for guiding the replacement of the filament F.

2. Operation

Figure 3:
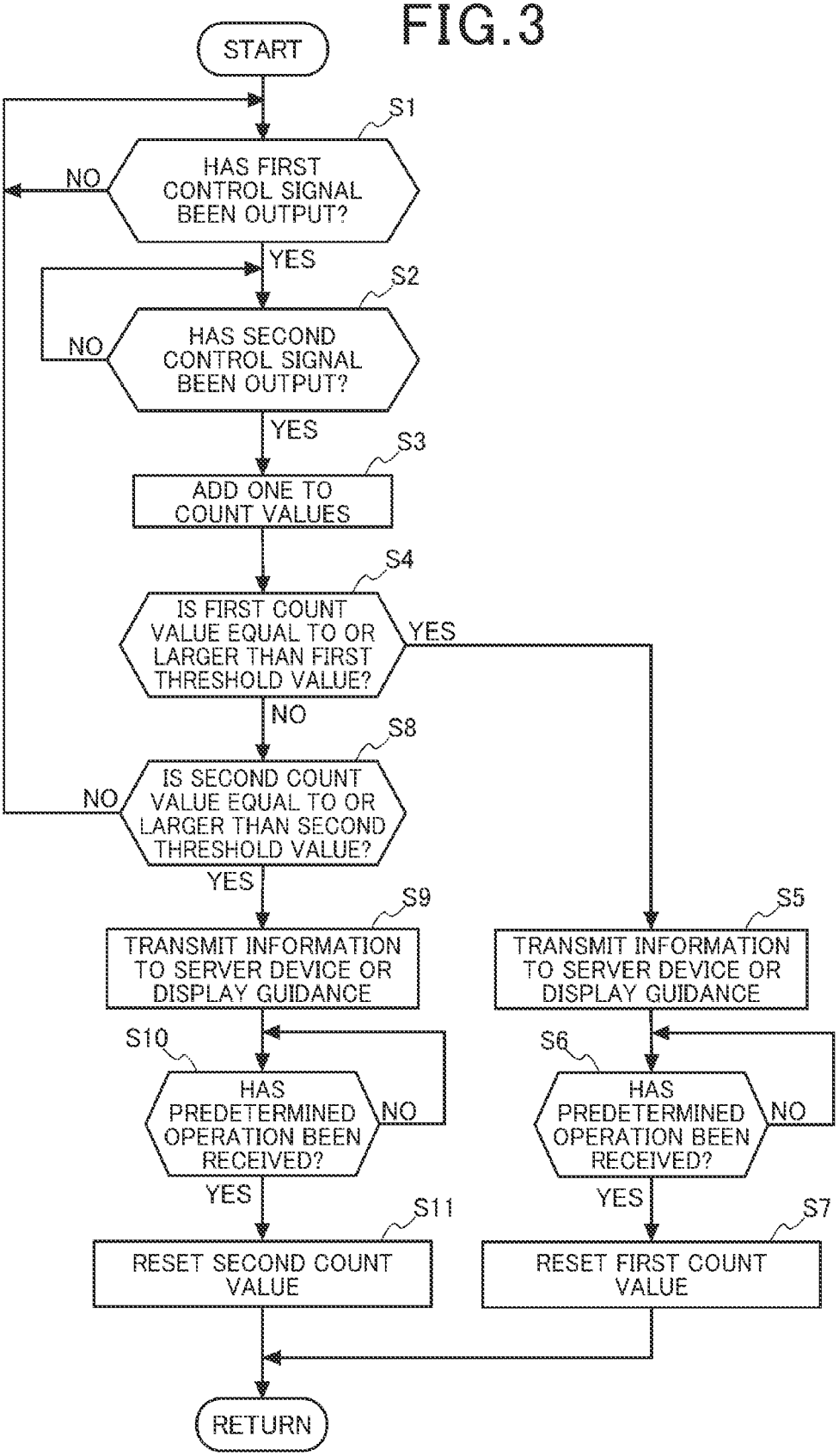
FIG. 3 is a flowchart illustrating an operation of a control device.

FIG. 3 is a flowchart illustrating an operation of the control device 100.

The operation of the control device 100 will be described with reference to FIG. 3.

First, the control device 100 determines whether or not the first control signal has been output to the high-voltage power source 220 (Step S1). When the first control signal is not output to the high-voltage power source 220 (Step S1/NO), the control device 100 returns to the determination of Step S1.

When the first control signal is output to the high-voltage power source 220 (Step S1/YES), the control device 100 determines whether or not the second control signal has been output to the high-voltage power source 220 (Step S2). When the second control signal is not output to the high-voltage power source 220 (Step S2/NO), the control device 100 returns to the determination of Step S2.

When the second control signal is output to the high-voltage power source 220 (Step S2/YES), the control device 100 adds one to the values of the first count value 111 and the second count value 113 (Step S3). Thereafter, the control device 100 determines whether or not the first count value 111 is equal to or larger than the first threshold value (Step S4).

When the first count value 111 is equal to or larger than the first threshold value (Step S4/YES), the control device 100 determines that the rubber member 250 is in the deterioration state. The control device 100 transmits the information indicating that the rubber member 250 is determined to be in the deterioration state and the identification information of the X-ray inspection apparatus 1 to the server device 300 (Step S5). In addition, the control device 100 may cause the display unit 60 to display a guidance for guiding that the rubber member 250 is determined to be in the deterioration state (Step S5). Thereafter, when the rubber member 250 is replaced and a predetermined operation is input by the operation unit 70 (Step S6/YES), the control device 100 resets the first count value 111 (Step S7). Thereafter, the control device 100 returns to the determination of Step S1.

When the first count value 111 is not equal to or larger than the first threshold value (Step S4/NO), the control device 100 determines whether or not the second count value 113 is equal to or larger than the second threshold value (Step S8). When the second count value 113 is not equal to or larger than the second threshold value (Step S8/NO), the control device 100 returns to the determination of Step S1.

When the second count value 113 is equal to or larger than the second threshold value (Step S8/YES), the control device 100 determines that the filament F is in the deterioration state. The control device 100 transmits the information indicating that the filament F is determined to be in the deterioration state and the identification information of the X-ray inspection apparatus 1 to the server device 300 (Step S9). In addition, the control device 100 may cause the display unit 60 to display a guidance for guiding that the filament F is determined to be in the deterioration state (Step S9). Thereafter, when the filament F is replaced and a predetermined operation is input by the operation unit 70 (Step S10/YES), the control device 100 resets the second count value 113 (Step S11). Thereafter, the control device 100 returns to the determination of Step S1.

3. Aspects and Effects

It is understood, by those skilled in the art, that the above-described present embodiment is a specific example of the following aspects.

(Item 1)

According to a first aspect, there is provided an X-ray inspection apparatus including: an X-ray tube configured to generate X-rays; a high-voltage power source configured to supply a tube voltage to the X-ray tube to generate X-rays; an X-ray irradiation control section configured to output a first control signal for causing the high-voltage power source to start supply of the tube voltage and a second control signal for causing the high-voltage power source to stop the supply of the tube voltage to control the high-voltage power source; and a determination section configured to count at least one of the first control signal and the second control signal output from the X-ray irradiation control section to the high-voltage power source, compare a counted count value with a preset threshold value, and determine a deterioration state of a component constituting the X-ray tube.

According to the X-ray inspection apparatus described in Item 1, it is possible to determine the deterioration state of the component constituting the X-ray tube based on the number of times of supply of the tube voltage supplied from the high-voltage power source to the X-ray tube. Therefore, it is possible to accurately determine the deterioration state of the component that is deteriorated when the tube voltage is supplied to the X-ray tube, and to avoid the occurrence of downtime or shorten the downtime.

(Item 2)

In the X-ray inspection apparatus described in Item 1, the determination section counts at least one of the first control signal and the second control signal output from the X-ray irradiation control section to the high-voltage power source, and when a counted count value is equal to or larger than a first threshold value included in the threshold value, the determination section determines that a rubber member that absorbs an increase due to thermal expansion of insulating oil with which the X-ray tube is filled is in a deterioration state.

According to the X-ray inspection apparatus described in Item 2, it is possible to accurately determine the deterioration state of the rubber member that absorbs the increase due to the thermal expansion of the insulating oil with which the X-ray tube is filled, and to avoid the occurrence of the downtime or shorten the downtime.

(Item 3)

In the X-ray inspection apparatus described in Item 1, the determination section counts at least one of the first control signal and the second control signal output from the X-ray irradiation control section to the high-voltage power source, and when a counted count value is equal to or larger than a second threshold value included in the threshold value, the determination section determines that a filament included in the X-ray tube is in a deterioration state.

According to the X-ray inspection apparatus described in Item 3, it is possible to accurately determine the deterioration state of the filament included in the X-ray tube, and to avoid the occurrence of the downtime or shorten the downtime.

(Item 4)

In the X-ray inspection apparatus described in Item 1, the determination section counts at least one of the first control signal and the second control signal output from the X-ray irradiation control section to the high-voltage power source, and when a counted count value is equal to or larger than a first threshold value included in the threshold value, the determination section determines that a rubber member that absorbs an increase due to thermal expansion of insulating oil with which the X-ray tube is filled is in a deterioration state, and the determination section counts at least one of the first control signal and the second control signal, and when a counted count value is equal to or larger than a second threshold value which is included in the threshold value and different from the first threshold value, the determination section determines that a filament included in the X-ray tube is in a deterioration state.

According to the X-ray inspection apparatus described in Item 4, it is possible to accurately determine the deterioration state of the rubber member that absorbs the increase due to the thermal expansion of the insulating oil with which the X-ray tube is filled, and to accurately determine the deterioration state of the filament included in the X-ray tube. Therefore, it is possible to avoid the occurrence of the downtime or shorten the downtime.

(Item 5)

The X-ray inspection apparatus described in any one of Items 1 to 4 further includes: a communication unit; and a communication control section configured to control the communication unit to communicate with a server device connected to a network, in which the communication control section notifies the server device of a component determined to be in a deterioration state when the determination section determines the deterioration state.

According to the X-ray inspection apparatus described in Item 5, it is possible to register the component determined to be in the deterioration state in the server device by communicating with the server device. Therefore, the part of the X-ray inspection apparatus can be replaced with reference to the information registered in the server device.

(Item 6)

According to the first aspect, there is provided a deterioration determination method for an X-ray inspection apparatus including an X-ray tube configured to generate X-rays, and a high-voltage power source configured to supply a tube voltage to the X-ray tube to generate X-rays, the deterioration determination method including: a step of counting at least one of a first control signal for causing the high-voltage power source to start supply of the tube voltage and a second control signal for causing the high-voltage power source to stop the supply of the tube voltage; and a step of determining a deterioration state of a component constituting the X-ray tube by comparing a counted count value with a preset threshold value.

According to the deterioration determination method for an X-ray inspection apparatus described in Item 6, it is possible to determine the deterioration state of the component constituting the X-ray tube based on the number of times of supply of the tube voltage from the high-voltage power source to the X-ray tube. Therefore, it is possible to accurately determine the deterioration state of the component that is deteriorated when the tube voltage is supplied to the X-ray tube, and to avoid the occurrence of downtime or shorten the downtime.

4. Other Embodiments

The X-ray inspection apparatus 1 according to the present embodiment is merely an example of an aspect of the X-ray inspection apparatus according to the present invention, and can be optionally modified and applied without departing from the gist of the present invention.

For example, in the present embodiment, the control device 100 of the X-ray inspection apparatus 1 includes the image processing section 131, the display control section 132, the movement control section 133, the X-ray irradiation control section 134, the determination section 135, and the communication control section 136, but the embodiment of the present invention is not limited thereto. For example, the control device 100 may be configured separately from the X-ray inspection apparatus 1. In addition, the control device 100 of the X-ray inspection apparatus 1 may execute some functions, and the control device provided separately from the X-ray inspection apparatus 1 may be caused to execute functions other than the functions executed by the control device 100 of the X-ray inspection apparatus 1. For example, the control device provided separately from the X-ray inspection apparatus 1 may be caused to execute the functions of the determination section 135 and the communication control section 136.

In addition, each functional unit illustrated in FIG. 1 indicates a functional configuration, and a specific implementation form is not particularly limited. That is, hardware individually corresponding to each functional unit does not necessarily need to be mounted, and it is of course possible to employ a configuration in which functions of a plurality of functional units are realized by one processor executing a program. In addition, some of the functions implemented by software in the above embodiment may be implemented by hardware, or some of the functions implemented by hardware may be implemented by software.

In addition, the processing unit of the flowchart illustrated in FIG. 3 is divided according to main processing contents in order to facilitate understanding of the processing of the control device 100. There is no limitation in the way of dividing or the name of the processing unit illustrated in the flowchart of FIG. 3, and the processing unit can be divided into more processing units according to the processing content. Alternatively, it is possible to divide the processing unit in a manner in which one processing unit includes more processing. In addition, the processing order in the above flowchart is not limited to the illustrated example.

The control program executed by the processor 130 included in the control device 100 can also be recorded in a computer-readable recording medium. As the recording medium, a magnetic or optical recording medium or a semiconductor memory device can be used. Specific examples thereof include portable or fixed recording media such as a flexible disk, an HDD, a compact disk read only memory (CD-ROM), a DVD, a Blu-ray (registered trademark) disc, a magneto-optical disk, a flash memory, and a card-type recording medium. In addition, the control program may be stored in a server device or the like, and the control program may be downloaded from the server device to the control device 100.

REFERENCE SIGNS LIST

1 X-ray inspection apparatus
10 X-ray irradiation unit
20 X-ray generation unit
30 X-ray detection unit
40 Stage
50 Moving mechanism
70 Operation unit
80 Communication unit
100 Control device
110 Memory
111 First count value
113 Second count value
115 Identification information
130 Processor
131 Image processing section
133 Movement control section
134 X-ray irradiation control section
135 Determination section
136 Communication control section
201 Chamber
203 Housing
205 Lid body
210 X-ray tube
211 Glass tube body
213 Anode portion
215 Cathode portion
220 High-voltage power source
231 Terminal
233 Wiring
235 Terminal
237 Wiring body
239 Terminal
250 Rubber member
300 Server device
F Filament

What is claimed is:

1. An X-ray inspection apparatus comprising:

an X-ray tube configured to generate X-rays;

a high-voltage power source configured to supply a tube voltage to the X-ray tube to generate X-rays;

an X-ray irradiation control section configured to output a first control signal for causing the high-voltage power source to start supply of the tube voltage and a second control signal for causing the high-voltage power source to stop the supply of the tube voltage to control the high-voltage power source; and a determination section configured to count at least one of the first control signal and the second control signal output from the X-ray irradiation control section to the high-voltage power source, compare a counted count value with a preset threshold value, and determine a deterioration state of a component constituting the X-ray tube.

2. The X-ray inspection apparatus according to claim 1, wherein the determination section counts at least one of the first control signal and the second control signal output from the X-ray irradiation control section to the high-voltage power source, and when a counted count value is equal to or larger than a first threshold value, the determination section determines that a rubber member that absorbs an increase due to thermal expansion of insulating oil with which the X-ray tube is filled is in a deterioration state.

3. The X-ray inspection apparatus according to claim 2, further comprising:

a communication unit; and a communication control section configured to control the communication unit to communicate with a server device connected to a network, wherein the communication control section notifies the server device of a component determined to be in a deterioration state when the determination section determines the deterioration state.

4. The X-ray inspection apparatus according to claim 1, wherein the determination section counts at least one of the first control signal and the second control signal output from the X-ray irradiation control section to the high-voltage power source, and when a counted count value is equal to or larger than a threshold value, the determination section determines that a filament included in the X-ray tube is in a deterioration state.

5. The X-ray inspection apparatus according to claim 1, wherein the determination section counts at least one of the first control signal and the second control signal output from the X-ray irradiation control section to the high-voltage power source, and when a counted count value is equal to or larger than a first threshold value, the determination section determines that a rubber member that absorbs an increase due to thermal expansion of insulating oil with which the X-ray tube is filled is in a deterioration state, and the determination section counts at least one of the first control signal and the second control signal, and when a counted count value is equal to or larger than a second threshold value and different from the first threshold value, the determination section determines that a filament included in the X-ray tube is in a deterioration state.

6. A deterioration determination method for an X-ray inspection apparatus including an X-ray tube configured to generate X-rays, and a high-voltage power source configured to supply a tube voltage to the X-ray tube to generate X-rays, the deterioration determination method comprising:

a step of counting at least one of a first control signal for causing the high-voltage power source to start supply of the tube voltage and a second control signal for causing the high-voltage power source to stop the supply of the tube voltage; and a step of determining a deterioration state of a component constituting the X-ray tube by comparing a counted count value with a preset threshold value.

* * * * *